US006887013B2

(12) United States Patent
Ley et al.

(10) Patent No.: US 6,887,013 B2
(45) Date of Patent: May 3, 2005

(54) DEVICE FOR TREATING SOILS OR ROAD SURFACES

(75) Inventors: Herbert Ley, St. Katharinen (DE); Peter Busley, Linz (DE); Walter Grueber, Neustadt/Wied (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/655,064

(22) Filed: Sep. 5, 2003

(65) Prior Publication Data

US 2004/0146353 A1 Jul. 29, 2004

(30) Foreign Application Priority Data

Sep. 5, 2002 (DE) ..... 102 41 067

(51) Int. Cl.[7] ..... E01C 23/00; B67D 1/08

(52) U.S. Cl. ..... 404/90; 404/92; 404/111; 222/149; 222/322; 239/87; 239/117

(58) Field of Search ..... 404/90, 92, 93, 404/94, 111; 222/148, 149, 322; 137/800; 239/87, 106, 117, 118

(56) References Cited

U.S. PATENT DOCUMENTS 2,394,017 A 2/1946 Seaman
2,614,885 A * 10/1952 Roell et al. ..... 239/118
4,384,674 A * 5/1983 Somerville ..... 239/118
5,054,959 A * 10/1991 Wilson et al. ..... 404/94
5,169,262 A * 12/1992 Wilson et al. ..... 404/84.05
5,741,085 A 4/1998 Wirtgen
5,893,677 A 4/1999 Haehn et al.
6,565,281 B2 5/2003 Bruns et al.

FOREIGN PATENT DOCUMENTS

WO 98/35102 * 8/1998

* cited by examiner

*Primary Examiner*—Gary S. Hartmann
(74) *Attorney, Agent, or Firm*—Diller, Ramik & Wight

(57) ABSTRACT

A device for treating soils or road surfaces includes a machine frame (1) carrying a working roll (4) in a working roll housing (8) defining a working space (6). The roll housing (8) is provided with a spraying mechanism (10) for binder or water having at least one outlet nozzle (12) opening directly into the working space (6). A controllable closing device (18) has a closing element (22) which, in an open position, unblocks the outlet nozzle (12) and in a first closed position, closes the outlet nozzle (12). The closing device (18) is capable of triggering an additional movement of the closing element (22) beyond the first closing position such that at a second closed position, material accumulations in and/or beyond the outlet nozzle (12) are removed.

12 Claims, 4 Drawing Sheets

DEVICE FOR TREATING SOILS OR ROAD SURFACES

BACKGROUND OF THE INVENTION

1. Field of the Invention

The present invention relates to a device for treating soils or road surfaces.

The present invention is based on the state of the art as described, e. g., in U.S. Pat. No. 6,565,281. Further generic devices are known from DE 42 06 994 A1, U.S. Pat. No. 5,741,085, U.S. Pat. No. 5,893,667 and U.S. Pat. No. 2,394,017 A.

2. Description of Related Art

The known devices for treating soils or road surfaces are provided with a working roll which breaks open the soil or road surfaces and thoroughly mixes the soil and road surface material. In the case of hard road surfaces made from asphalt or concrete the road surfaces are milled. The working roll is surrounded by a bell-shaped roll housing which encloses a working space of the working roll, said working space serving as a mixing space for mixing the worked-off soil material with hydraulic or bituminous binders or with water. The hydraulic or bituminous binders or the water are injected into the working space with the aid of a spraying means fixed to the roller housing, wherein a plurality of outlet nozzles of the spraying means on the roll housing are arranged such that they are directed into the working space. The cutting circle of the tools of the working roll has, in operation, a relatively small distance of e.g. approximately 50 mm to the roll housing, wherein the worked-off soil or road surface material is moved past the inside of the roll housing due to the rotary movement of the working roll. It is a drawback that the worked-off material mixed with binders or water can be pressed into the outlet nozzles even at a high spraying pressure or accumulate before the outlet nozzle. In particular after a standstill of the machine there is the risk that the outlet nozzles are contaminated or clogged by set or hardened or dried worked-off material from the working space, whereby the spraying operation may be affected or even completely stopped.

Cleaning of the outlet nozzles is very problematic because of their difficult-to-access position in the roll casing and may require dismantling of the working roll. Dismantling of the the outlet nozzles from outside the roll housing is very complicated since the injection ramp carrying the injection nozzles, which is arranged between the roll housing and the machine frame, is inaccessible or difficult to access.

Cleaning of the outlet nozzles inside the roll housing involves accident hazards, e.g. when cooled bitumen must be melted with an unshielded flame. Further health hazards occur due to the use of solvents.

SUMMARY OF THE INVENTION

It is an object of the invention to improve a device for treating soils and road surfaces using outlet nozzles of a spraying means directed into the working space to the effect that the cleaning and maintenance expenditure is kept at a minimum with accident hazards being excluded.

According to the present invention, the at least one outlet nozzle comprises a controllable closing means having a closing element which, in an open position, unblocks the outlet nozzle and, in a closed position, closes the outlet nozzle. The closing means can effect an additional movement of the closing element beyond the closed position such that cloggings at and/or in the outlet nozzles can be removed.

With the aid of the controllable closing means the outlet nozzle can either be completely unblocked or closed at any time such that during or after a working cycle no contaminations can enter the outlet nozzle from outside, which contaminations may lead to partial or complete clogging of the outlet nozzle.

Preferably, the closing element of the closing means can effect an additional movement, preferably a stroke movement, beyond the closed position such that contaminations located before the outlet nozzle can also be automatically removed. Thus the closing element of the controllable closing means has three optionally controllable positions. This ensures that the compound produced during the mixing process from the worked-off soil or road surface material and the hydraulic or bituminous binders or the water cannot partly or completely close the outlet nozzles from outside after the compound has cooled or hardened or set.

Since the additional stroke movement can be effected at any time when required, i.e. during standstill of the working roll or in particular prior to resumption of operation or after stopping of the operation, extensive cleaning and maintenance work is not required when the machine is started again. The outlet nozzles facing the working space of the working roll are thus always ready for operation to the full extent and cannot lead to uneven distribution of the hydraulic or bituminous binder or the water due to partial clogging or complete failure. The closed position of the closing element can also be used for shutting off the outlet nozzles of the spraying means for the purpose of flow control.

Preferably, the closing element is movable coaxially to the outlet nozzle.

The nozzle cross-section of the outlet nozzle and the cross-section of the closing element are adjusted to each other and are preferably circular. The fit between the bore of the outlet nozzle and the closing element is adjusted to all media to be sprayed (binder or water) in such a way that, in the closed position and without any pressure being applied, no medium can leave the outlet nozzle. On the other hand, the clearance is large enough to prevent the closing element from getting stuck even at higher operating temperatures.

The outlet nozzle can be connected to a ring line or a tank.

In particular, the outlet nozzle may be arranged at a line or an injection chamber, wherein the hydraulic or bituminous binder or the water can be supplied transversely to the outlet nozzle. For the purpose of closing or cleaning the outlet nozzle, the closing element passes through the line or the injection chamber and is guided coaxially to the outlet nozzle. In the open position the closing element essentially completely unblocks the cross-section of the line or the injection chamber. In this case, the hydraulic or bituminous binder or the water is allowed to unimpededly flow to the outlet nozzle. If a ring line is used, the binder or the water can flow past the outlet nozzles even in the closed position of the closing element.

Preferably, the closing element is set back relative to the roll housing shell facing the working space. In the set-back position of the closing element the closing element is more efficiently protected from being damaged by hard worked-off material. The front tip of the closing element is approximately flush with the end of the outlet nozzle channel facing the working space.

It may be provided that the additional movement of the controllable closing element can be automatically triggered by a sensor means for the purpose of cleaning the outlet nozzle. Actuation of the closing element is reasonable in particular during the start and after termination of a working cycle.

Automatic triggering may be effected e.g. as a function of exceeding of a limit pressure value at the outlet nozzle. Preferably, a linear stroke movement is performed coaxially to the nozzle channel of the outlet nozzle.

The nozzle inlet opening of the outlet nozzle and/or the tip of the closing element a chamfered. This ensures increased safety of operation.

In one embodiment of the present invention, the spraying means comprises a mixing means having an expansion chamber in which hot bitumen supplied via a bitumen injection nozzle can be mixed with water or with water and air for producing foamed bitumen, wherein foamed bitumen emerges from the outlet nozzle. The bitumen injection nozzle for hot bitumen comprises a controllable valve tappet adjusted to the nozzle inlet opening of the bitumen injection nozzle, said valve tappet being adapted for closing the nozzle inlet opening.

According to a preferred embodiment, the closing element of the losing means is controllable by a piston-cylinder unit having three switching positions. For this purpose, the piston-cylinder unit comprises a second piston element which allows the stroke of the piston element to be limited when pressure is applied.

BRIEF DESCRIPTION OF THE DRAWINGS

Hereunder preferred embodiments of the present invention are explained in detail with reference to the drawings in which.

DETAILED DESCRIPTION OF PREFERRED EMBODIMENTS

Figure 1:
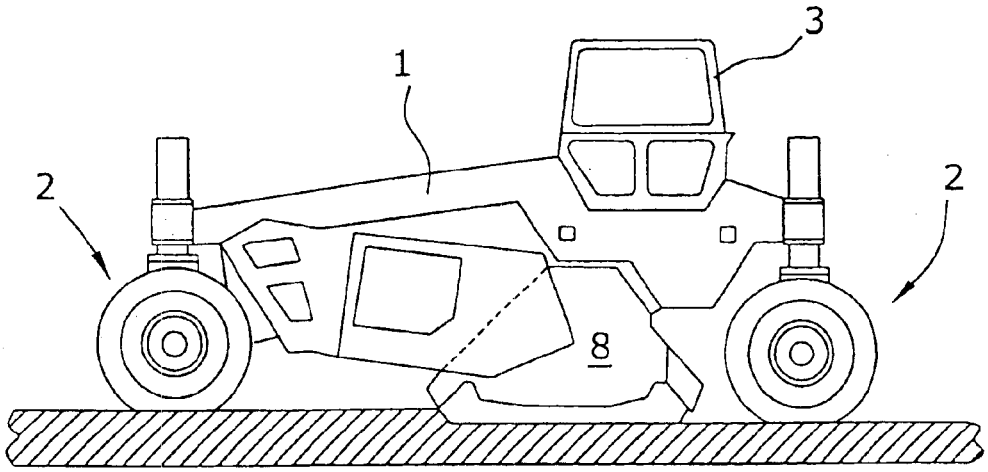
FIG. 1 shows a road making machine.
Figure 2:
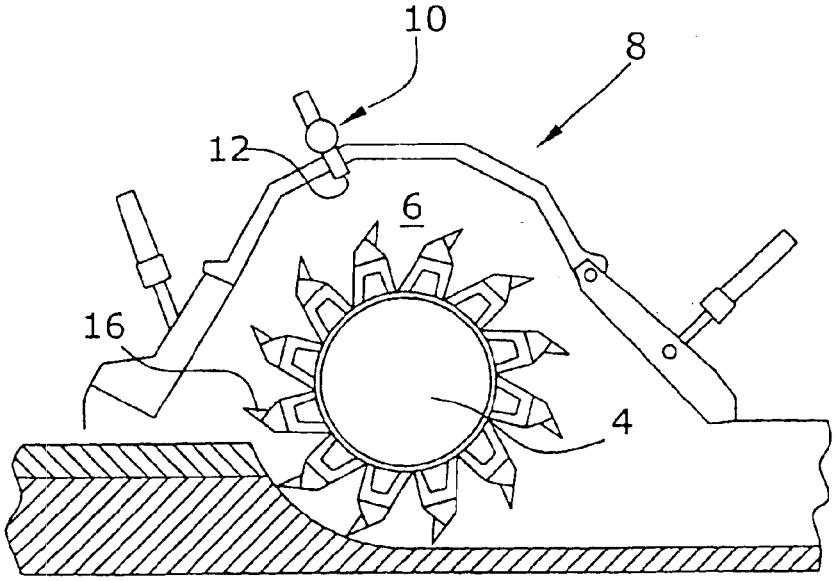
FIG. 2 shows the working space of a working roll under a roll housing comprising a spraying means.

FIG. 1 shows an automotive device for treating road surfaces, said device comprising a machine frame 1 carried by wheels 2 and a driver's stand in the form of a driver's cabin 3. The wheels 2 can be individually driven and alternatively be substituted by endless chains.

Below the machine frame 1 a working roll 4 is arranged in a roll housing 8 defining the working space 6 of the working roll 4 towards the top and towards the sides.

The roll housing 8 comprises, in its upper portion, a spraying means 10 by means of which binder or water can be injected into the working space 6 via a plurality of outlet nozzles 12 preferably arranged side by side.

The binder can be a hydraulic or a bituminous binder, and mixtures of hydraulic binders and water can be suspensions, and mixtures of bituminous binders and water can be emulsions. Further, foamed bitumen can be injected via the outlet nozzles 12, wherein heated liquid bitumen is mixed with cold water for producing foamed bitumen. Thus the bitumen foams up, with the original volume of the components experiencing an approximately twentyfold increase.

Figure 3C:
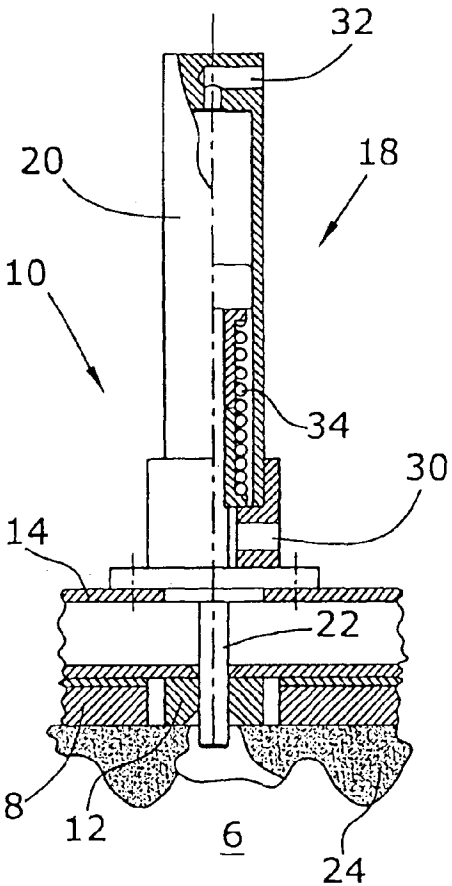
FIGS. 3*a* to 3*c* show an outlet nozzle of the spraying means in three different switching positions.
Figure 3B:
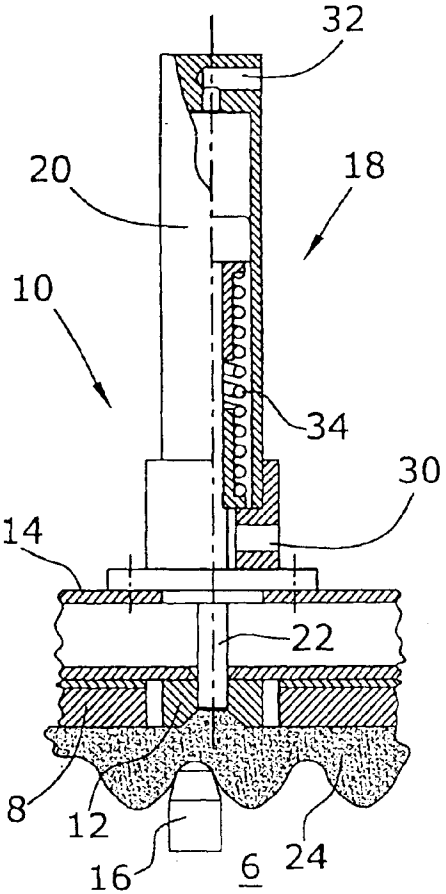
Figure 3A:
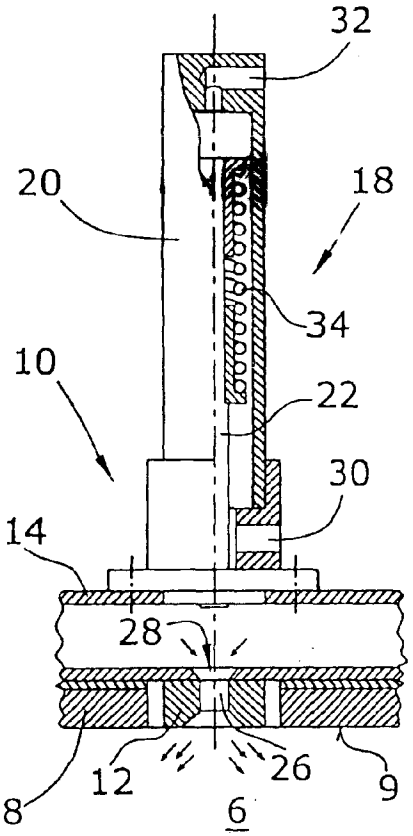

FIGS. 3*a* to 3*c* show a first embodiment wherein the spraying means 10 receives the binder or the water via a line 14 which may be a ring line. The binder and the water, respectively, flow transversely to the outlet nozzle 12. The outlet nozzle 12 fixed to the line 14 is directed into the working space 6 and arranged in a recess of the roll housing 8 matched to the outlet nozzle 12. The tools 16 of the working roll have a cutting circle which may have a relative small distance of e.g. approximately 50 mm to the roll housing 8. For each outlet nozzle 12 a closing means 18 is provided which comprises a piston-cylinder unit 20 whose piston rod forms or drives a closing element 22 for the outlet nozzle 12. The closing means 18 which can e.g. be controlled by a control unit allows three switching positions to be assumed by the closing element 22. In an open position of the closing element 22 shown in FIG. 3*a* the outlet nozzle and the flow cross-section of the line 14 are unblocked. In the closed position shown in FIG. 3*b* the outlet nozzle 12 is closed such that no binder or water emerges from said outlet nozzle 12. Further, no worked-off material 24 mixed with binder or water can enter the nozzle channel 26 of the outlet nozzle 12. If a ring line is used, its flow cross-section is only slightly reduced such that a circulation in the ring line can be maintained. The tip of the closing element 22 facing the working space 6 ends at the end of the nozzle duct 26 facing the working space 6 and is set back relative to the shell 9 of the roll housing 8 facing the working space 6 to prevent the closing element 22 from being damaged during operation.

FIG. 3*c* shows the closing element 22 in a third switching position in which the closing element 22 can remove material accumulations of the worked-off material 24 in and/or before of the outlet nozzle 12 by effecting an additional stroke movement beyond the closed position.

The nozzle cross-section in the nozzle channel 26 of the outlet nozzle 12 and the cross-section of the closing element 22 are adjusted to each other and are preferably circular-cylindrical. The fit of the nozzle channel 26 and the closing element 22 is selected such that, when no operating pressure prevails in line 14, no binder or water can emerge from the outlet nozzle 12. The nozzle inlet opening 28 and/or the tip of the closing element 22 may be chamfered to increase the operating safety of the closing means 18.

The piston-cylinder unit 20 of the closing means 18 operates as follows:

When pressure is applied to the pressure connection 30 of the piston-cylinder unit 20, the closing element is in the open position, as shown in FIG. 3*a*. When pressure is applied to the pressure connection 32, the closing element 22 is in the closed position shown in FIG. 3*b*. For triggering the additional stroke movement of the closing element 22 a considerably higher pressure is applied to the pressure connection 32 such that the piston element of the piston-cylinder unit compresses a compression spring 34 in the cylinder of the piston-cylinder unit 20 thus allowing an additional stroke of approximately 20 mm to be performed.

The additional stroke movement is preferably performed at the beginning of a working cycle and/or at the end of a working cycle. During operation of the machine it would not be advisable to actuate the closing element 22 such that it moves beyond the closing position since the closing element 22 may be damaged during operation.

The additional stroke movement of the closing element 22 for the purpose of cleaning the outlet nozzle 12 can be automatically triggered at the beginning or the end of a working cycle or can be triggered as a function of a measuring signal from a sensor means, which can indicate, e.g. via pressure monitoring at the outlet nozzle 12, partial or complete clogging of the outlet nozzle 12.

The line 14 may also be connected with a tank containing a binder or water.

Figure 4:
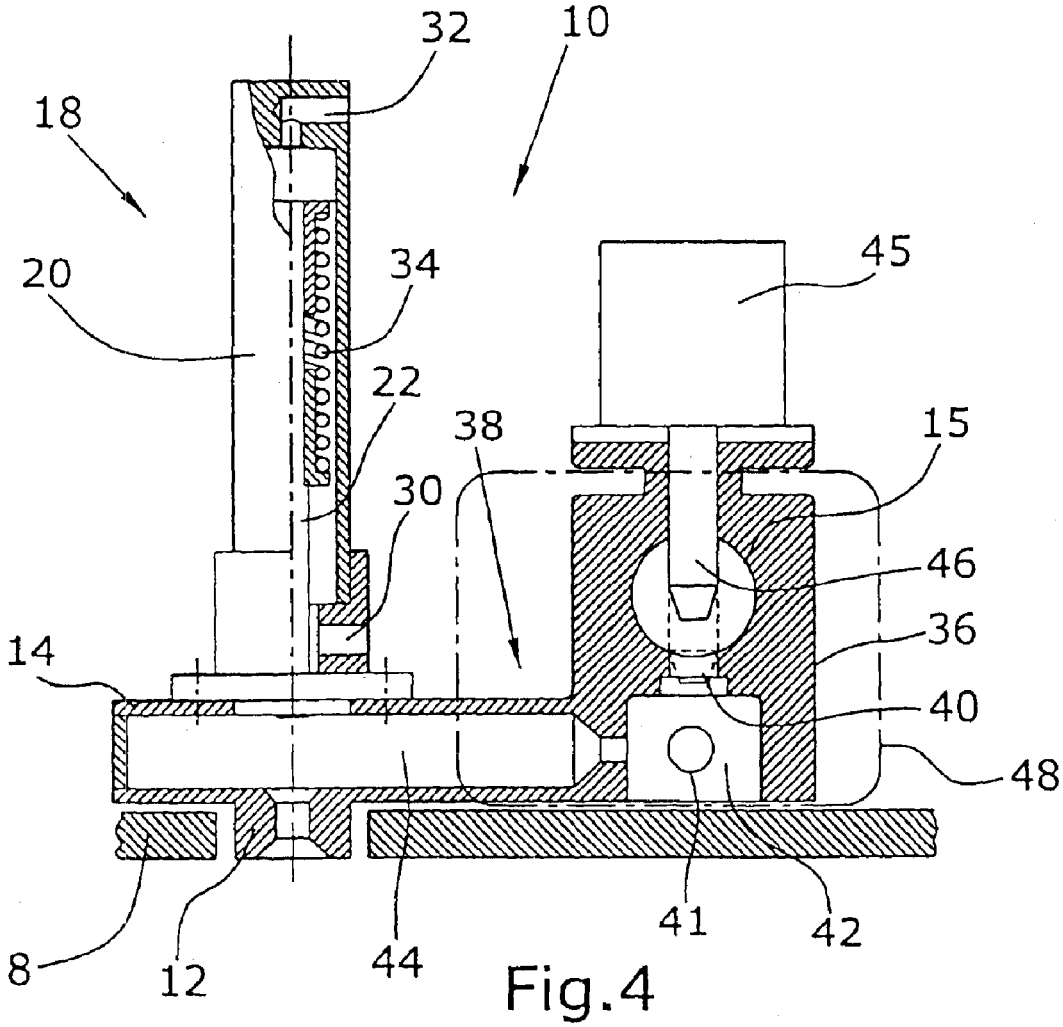
FIG. 4 shows an embodiment of an outlet nozzle for foamed bitumen.

FIG. 4 shows an embodiment of a spraying means 10 for foamed bitumen, said spraying means 10 comprising a mixing means 36. The mixing means 36 comprises an expansion chamber 38 in which hot bitumen supplied via a bitumen injection nozzle 40 can be mixed with water or with water and air for producing foamed bitumen. The expansion chamber 38 shown in FIG. 4 comprises a mixing chamber 42 and an injection chamber 44 connected with the mixing chamber 42, wherein the outlet nozzle 12 and the associated closing means 18 are arranged at the injection chamber 44. The hot bitumen is fed via a ring line 14, wherein a valve tappet 46 actuated by a controllable driving means can close or unblock the nozzle inlet opening of the bitumen injection nozzle 40. Water or water and air can be supplied to the mixing chamber 42 via one or two connections 41.

The mixing means 36 may be surrounded by a heating means 48 which prevents the bitumen from hardening during operation. The closing element 22 of the closing means 18 passes through the injection chamber 44 for the purpose of closing or cleaning the outlet nozzle 12.

Figure 5:
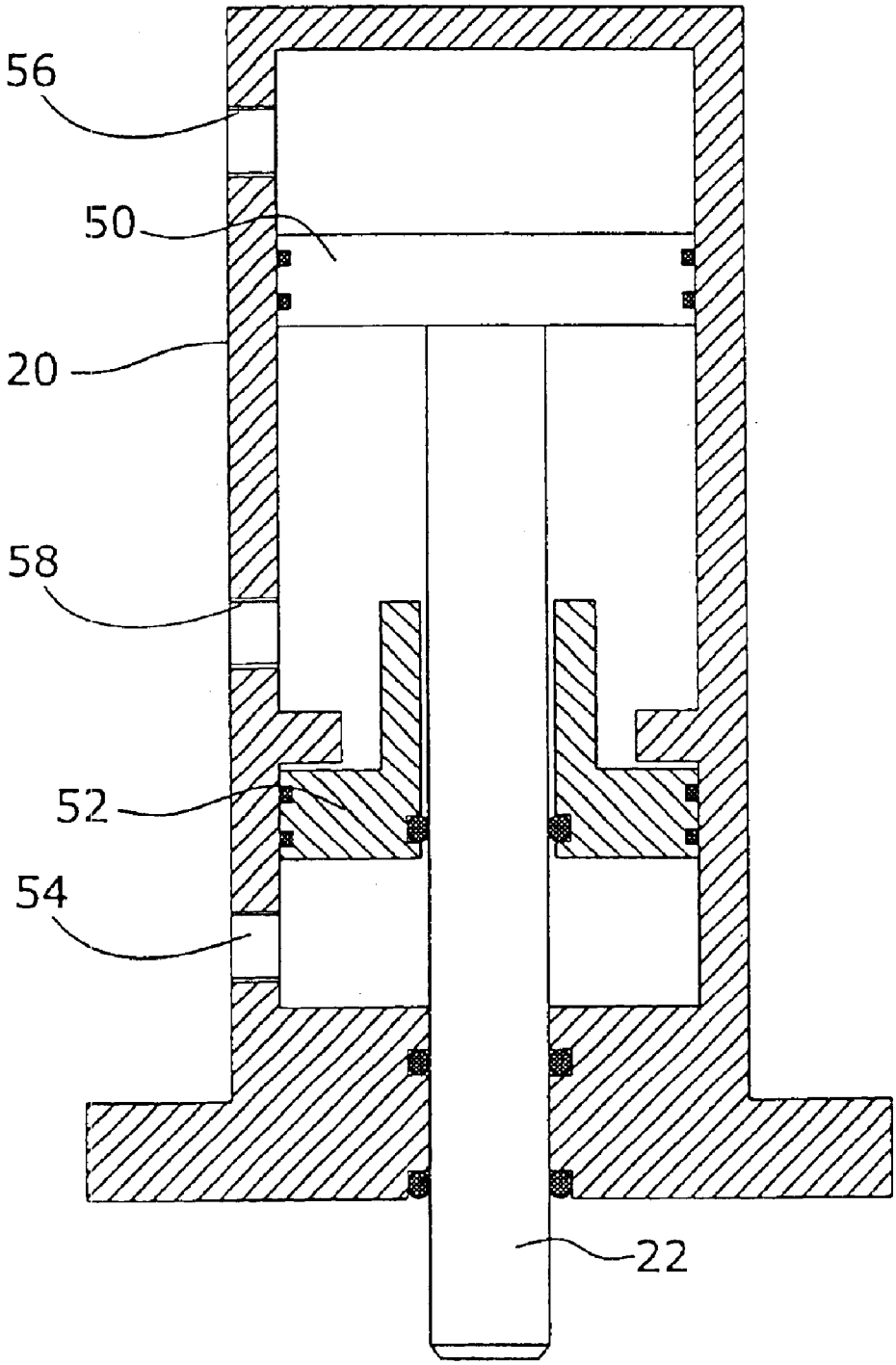
FIG. 5 shows an alternative driving means for the closing element at the spraying means.

The embodiment shown in FIG. 5 of the piston-cylinder unit 20 operates without a compression spring 34 and comprises a first piston element 50 at the free end of which the closing element 22 is arranged or which drives the closing element 22.

A second piston element 52 limits the stroke movement of the first piston element 50 when a considerably higher pressure is applied to a pressure connection 54 of the piston-cylinder unit 20 than to a pressure connection 56. The mode of operation of this piston-cylinder unit is thus as follows:

When pressure is applied to the pressure connection 54 the closing element 22 can be moved into its closed position when an additional pressure is applied to the pressure connection 56, or can be moved into its open position when pressure is applied to the pressure connection 58.

When pressure is applied to the pressure connection 56 with simultaneous pressure relief of the pressure connection 54 the closing element 22 can perform the cleaning stroke beyond the closed position such that material accumulated in or before the outlet nozzle 12 can be removed.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A device for treating soils or road surfaces comprising a machine frame (1) carrying a working roll (4) in a working roll housing (8) and defining therewith a working space (6), the working roll housing (8) being provided with spraying means (10) for a binder or water and having at least one outlet nozzle (12) opening directly into the working space (6), a controllable closing means (18) having a closing element (22) which, in an open position, unblocks the outlet nozzle (12) and, in a first closed position, enters and closes the outlet nozzle (12), and the closing means (18) being further operative to trigger additional movement of the closing element (22) beyond the first closed position to a second closed position at which material accumulated in and/or beyond the outlet nozzle (12) is removed by the closing element (22).

2. The device according to claim 1 wherein the closing element (22) is movable coaxially relative to the outlet nozzle (12).

3. The device according to claim 1 wherein the nozzle cross-section of the outlet nozzle (12) and the cross-section of the closing element (22) are substantially similar to each other and are preferably circular-cylindrical.

4. The device according to claim 1 wherein the outlet nozzle (12) is connected to a ring line (14) or a tank.

5. The device according to claim 1 wherein the outlet nozzle (12) is arranged in one of a line (14) and an injection chamber (44) with one of the binder and the water being supplied transversely to the outlet nozzle (12), the closing element (22) passes through one of the line (14) or the injection chamber (44) and coaxially enters the outlet nozzle (12) for closing and cleaning the outlet nozzle (12), and the closing element (22), in its open position completely unblocks one of the line (14) and the injection chamber (44).

6. The device according to claim 1 wherein the closing element (22) in its first closed position is set back relative to an opening (26) of a shell (9) of the roll housing (8) facing the working space (6).

7. The device according to claim 1 including sensor means for automatically triggering the additional movement of the closing element (22) from its first closed position to its second closed position for cleaning the outlet nozzle (12).

8. The device according to claim 1 wherein one of a nozzle inlet surface (28) of the outlet nozzle (12) and a tip of the closing element (22) is chamfered.

9. The device according to claim 1 wherein the spraying means (10) includes mixing means (36) having an expansion chamber (38) in which hot bitumen is supplied via a bitumen injection nozzle (40) which is mixed with one of water and water and air for producing foamed bitumen with the foamed bitumen emerging from the outlet nozzle (12).

10. The device according to claim 9 wherein the expansion chamber (38) includes a mixing chamber (42) and an injection chamber (44) connected with said mixing chamber (42), and the outlet nozzle (12) and the closing means (18) is arranged at the injection chamber (44).

11. The device according to claim 9 wherein the bitumen injection nozzle (40) for hot bitumen includes a controllable valve tappet (46) matched to the nozzle inlet surface (28) for closing the nozzle inlet surface (28).

12. The device according to claim 1 wherein the closing element (22) of the closing means (18) is driven by a piston-cylinder unit (20) having a plurality of switching positions.

* * * * *